United States Patent [19]

Buckley

[11] 4,230,160

[45] Oct. 28, 1980

[54] ADJUSTABLE SUCK-BACK DEVICE FOR SANITARY PUMPS

[75] Inventor: Lawrence W. Buckley, Baltimore, Md.

[73] Assignee: National Instrument Company, Inc., Baltimore, Md.

[21] Appl. No.: 968,261

[22] Filed: Dec. 11, 1978

[51] Int. Cl.[3] ..... B65B 3/32; F04B 7/00

[52] U.S. Cl. ..... 141/116; 137/DIG. 2; 417/446; 417/567

[58] Field of Search ..... 137/DIG. 2; 141/89, 141/115, 116, 126, 127; 417/446, 567, 568

[56] References Cited

U.S. PATENT DOCUMENTS

| | | | |
|---|---|---|---|
| 1,989,870 | 2/1935 | Lafferty, Jr. | 137/DIG. 2 |
| 3,771,908 | 11/1973 | Rosen | 417/446 |

*Primary Examiner*—Frederick R. Schmidt
*Attorney, Agent, or Firm*—Craig & Antonelli

[57] ABSTRACT

A suck-back arrangement for a sanitary filling unit in which a threaded adjusting member adapted to be selectively moved into and out of the path of the valve member of the outlet valve assembly is in threaded engagement only with a support member disposed externally of the outlet valve assembly while an unthreaded portion of the adjusting member extends into an unthreaded bore of the outlet valve housing so that no threaded parts are exposed to or come in contact with the product dispensed by the filling unit.

19 Claims, 5 Drawing Figures

ADJUSTABLE SUCK-BACK DEVICE FOR SANITARY PUMPS

The present invention relates to an adjustable suck-back device for sanitary pumps used in connection with high-speed filling machines.

In connection with filling machines equipped with pump units, of the type disclosed in U.S. Pat. Nos. 2,807,213; 2,907,614; and 4,077,441, it is known that so-called suck-back devices may be desirable or necessary with semi-viscous and viscous materials to eliminate stringing or dripping of the material dispensed through the nozzle or nozzles into the containers. Various suck-back devices are known in the prior art. For example, a variable pressure suck-back device is described in the U.S. Pat. No. 2,978,149 in which an external hose connection with an adjustable valve in the form of a variable hose clamp was used. However, this arrangement required an external connection involving a hose subject to wear, and entailed relatively high manufacturing costs to install silver-soldered nipples for the external connection. To alleviate the need for an external connection, a suck-back device was proposed in the U.S. Pat. No. 3,771,908 in which a variable suck-back effect was attainable without the need for external connections by the use of an adjustable member preventing complete closure of the valve ball of the outlet valve assembly. While the suck-back device of this last-mentioned U.S. patent offered several advantages over the prior art suck-back devices and proved quite successful, it entailed again certain shortcomings, especially when used in applications requiring frequent cleaning of the part. More specifically, certain industries such as, for example, the dairy (milk) industry and pharmaceutical industry require frequent cleaning and sterilization of all of the parts of the filling machine which come into contact with the dispensed product. The presence of any threaded connection thereby poses particular problems due to the difficulty in cleaning and/or sterilizing such threaded parts. The use of sanitary pumps avoiding threaded connections wherever possible has become increasingly widespread in these applications to eliminate this problem. On the other hand, the suck-back arrangement of the U.S. Pat. No. 3,771,908 utilized a threaded connection between the threaded adjusting member and the threaded bore provided therefor in the outlet valve assembly which was exposed to contact with the product to be dispensed under pressure by the filling unit.

Accordingly, the present invention is concerned with the task to eliminate the aforementioned problems and to provide a suck-back device devoid of any threaded connection exposed to the product to be dispensed by the filling machine. The underlying problems are solved with a filling unit of the type described above in that the member provided for the manual adjustment of the suck-back effect is in threaded engagement only with a support member external of the outlet valve housing and extends with an unthreaded portion into an unthreaded bore of the outlet valve housing. In one embodiment according to the present invention, the threaded adjusting member, whose position relative to the valve member is adjusted by rotation thereof, projects into the path of the valve member as the latter seeks to engage its valve seat during the suction stroke of the filling unit and is more or less prevented from fully closing by the presence of the adjusting member. The unthreaded bore in the outlet valve housing thereby extends approximately in the radial direction of the valve ball. To assure a tight sealing action between the unthreaded bore in the outlet valve housing and the unthreaded portion of the adjusting member, the latter is provided with an annular groove to receive a sealing ring. Since the sealing ring can be readily removed from the annular groove, the various parts of the suck-back mechanism which might come into contact with the dispensed product, can be easily cleaned and sterilized if necessary. Moreover, sealing rings made of a material compatible with the product to be dispensed can be readily exchanged depending on the given product, for which the filling unit is to be used.

In one particularly appropriate embodiment of the present invention, the support member is securely, yet removably, non-threadably connected with the outlet valve housing which, for that purpose, includes a stepped portion forming a shoulder to be engaged by the support member which is approximately L-shaped in side view and is provided with an opening in its longer leg substantially complementary to the external configuration of the stepped portion and with a threaded bore in the shorter leg to receive the threaded portion of the adjusting member. The location of the threaded bore in the L-shaped support member is substantially coaxial with the unthreaded bore in the outlet valve housing when the support member engages with its longer leg at the shoulder formed by the stepped portion in the valve housing. The thickness of the first leg of the support member thereby corresponds to the height of the stepped portion in the axial direction of the outlet valve.

While the present invention is applicable to any filling unit, it is particularly significant with so-called sanitary filling units whose various components are held together without the use of any threaded connection.

Accordingly, it is an object of the present invention to provide a filling unit with a suck-back device which avoids the aforementioned shortcomings and drawbacks encountered in the prior art.

Another object of the present invention resides in a filling unit equipped with a suck-back device which can be readily cleaned and/or sterilized when used in sanitary applications.

A further object of the present invention resides in a filling unit equipped with a variable suck-back device devoid of any threaded connections exposed to or likely to come in contact with the product to be dispensed by the filling unit.

Still a further object of the present invention resides in a suck-back device for a filling unit of the type described above, which is relatively simple and inexpensive in manufacture, easy to assemble and disassemble and particularly suitable for easy cleaning and/or sterilization.

These and other objects, features and advantages of the present invention will become more apparent from the following description when taken in connection with the accompanying drawing which shows, for purposes of illustration only, one embodiment in accordance with the present invention, and wherein.

Figure 1:
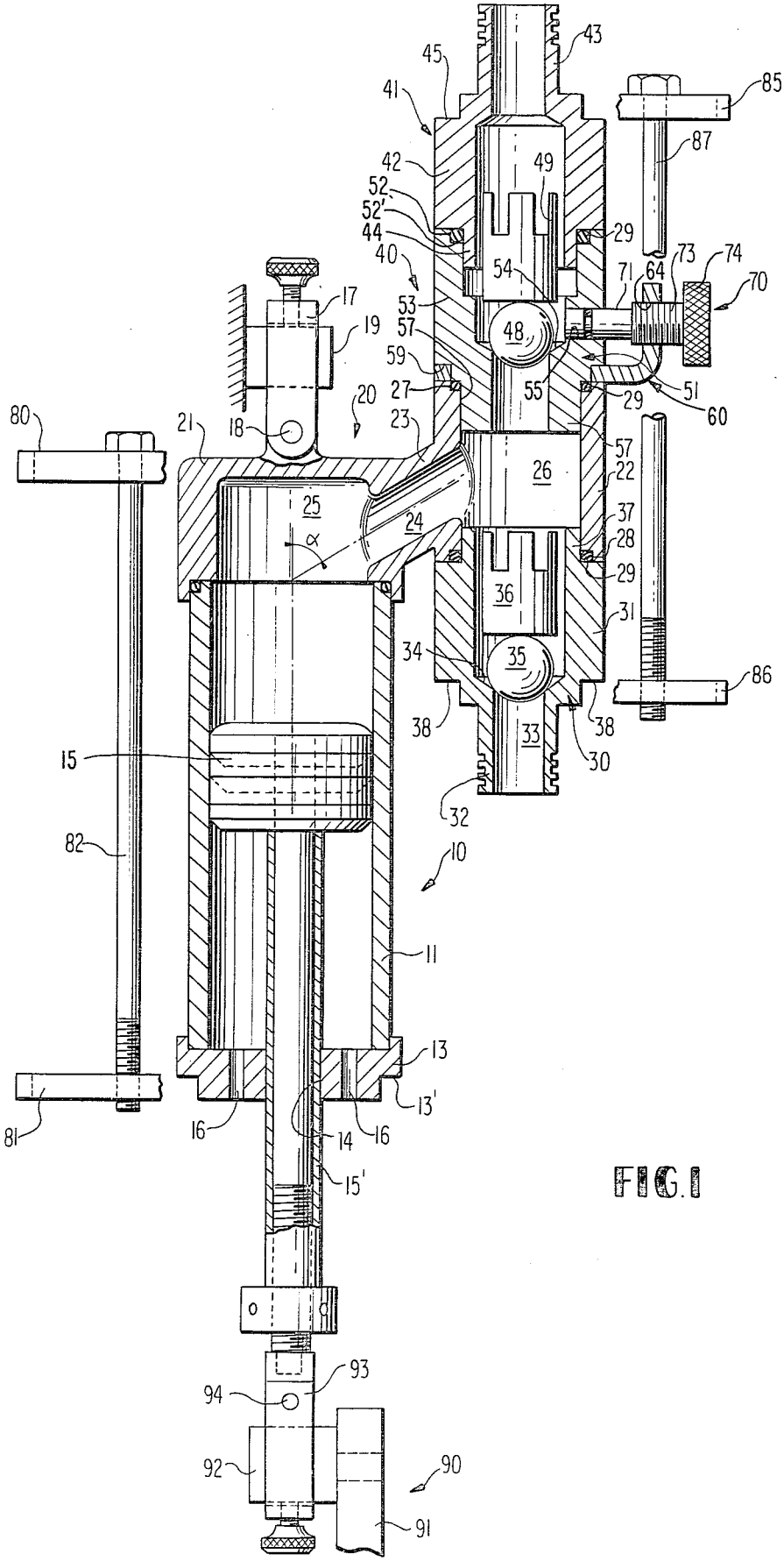
FIG. 1 is an axial cross-sectional view through a filling unit equipped with a sanitary suck-back device in accordance with the present invention, showing the various parts thereof in the position of zero suck-back effect.

Referring now to the drawing wherein like reference numerals are used throughout the various views to designate like parts, a filling unit generally designated by reference numeral 10 includes a cylinder 11 whose lower end is closed off by a lower cylinder head 13 provided with a through-bore 14 for a piston rod 15' carrying a piston assembly 15. The lower cylinder head 13 is additionally provided with venting ports 16. The lower end of the piston rod 15' is drivingly connected with a crank pin 92 of a driving disk 91 of an eccentric drive generally designated by reference numeral 90 and only schematically illustrated, by way of the lower swivel member 93 pivotally connected with the piston rod 15' by way of a pivot pin 94.

The upper end of the cylinder 11 is closed off by the upper cylinder head assembly generally designated by reference numeral 20 which consists of a cylinder end closure portion 21, a boss 22 and a connecting portion 23 provided with a bore 24 forming a communicating passageway between the pump space 25 and the valve space 26 disposed between the inlet valve assembly generally designated by reference numeral 30 and the outlet valve assembly generally designated by reference numeral 40. The end closure portion 21 for the upper end of the cylinder 11 is pivotally connected with a relatively fixed part 19 (schematically illustrated) of the filling machine (not shown) by way of the upper swivel member 17 pivotally connected with the end closure portion 21 by a pivot pin 18. At its upper and lower end, the boss 22 is provided with a stepped portion 27 and 28, respectively, to form a space for the accommodation of sealing rings, for example, of O-rings 29 to assure fluid-tightness between the respective parts of the inlet and outlet valve assembly and the boss 22, as will be described more fully hereinafter.

The inlet valve assembly 30 includes a cylindrical main section 31 adjoined in one direction by the connecting nipple 32 defining an inlet bore 33. A valve seat 34 for a ball valve 35 held in its closed position by a valve weight 36 is formed intermediate the inlet bore 33 and the internal space defined by the main cylindrical section 31. A sleeve-like extension 37 which projects from the main cylindrical section 31 in a direction toward the valve space 26 engages internally in the boss 22 and together with the stepped portion 28 provides the space for the O-ring 29.

The outlet valve assembly 40 includes a first part generally designated by reference numeral 41 and a second part generally designated by reference numeral 51. The first part 41 again includes a main cylindrical section 42 adjoined on one side by a connecting nipple 43 and on the other side by a sleeve-like extension 44 cooperating with the stepped portion 52 forming shoulder 52' in the main cylindrical portion 53 of the second part 51 to form therewith a space for the sealing ring 29. An outlet valve ball 48 normally urged into its closing position by a valve weight 49 is adapted to engage with its valve seat 54 formed in the main cylindrical section 53. The parts of the filling unit so far described are known in the art and may be of any known type. Moreover, the various parts of the filling unit, and more specifically the parts 11, 13 and 21 of the pump unit as well as the parts 22, 31, 41 and 51 of the inlet and outlet valve assemblies may be secured together in any suitable known manner. However, particularly for use in connection with sanitary pumps, these various parts are preferably non-threadably secured together by the use of clamping members 80, 81, 85 and 86 and of a suitable member of clamping bolts 82 and 87 whereby the clamping member 80 which is of appropriate cross section engages with its peripheral rim over the end closure member 21 and the clamping member 81 engages at shoulder 13' of the lower cylinder head 13 when these two clamping members 80 and 81 are axially urged toward one another by the clamping bolts 82. Similarly, the clamping member 85 engages at the shoulder 45 formed at the upper end of the cylindrical section 42 and the clamping member 86 engages at the shoulder 38 formed at the lower end of the cylindrical section 31 when these two clamping members 85 and 86 are axially urged toward one another by the clamping bolts 87. Such an arrangement permits easy assembly and disassembly of the various parts without the use of any threaded connections exposed to the material to be dispensed by the filling unit. Furthermore, to facilitate the cleaning of the communicating passage 24 without the need of a threaded plug which has to be removed for that purpose, the communicating passage is angularly inclined at an angle $\alpha$ which is less than 90°, preferably between 45° and 75°, depending on other design aspects of the pump.

Figure 2:
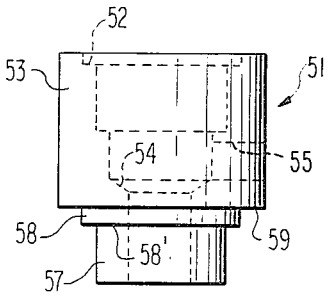
FIG. 2 is an elevational view of a section of the outlet valve assembly containing the variable suck-back device of the present invention.
Figure 3:
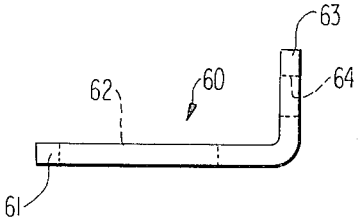
FIG. 3 is a side elevational view of the support member for the sanitary suck-back device according to the present invention.
Figure 4:
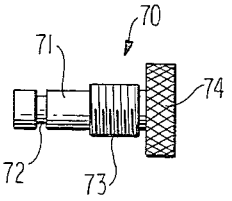
FIG. 4 is a side elevational view of the adjusting member for the santiary suck-back device according to the present invention.

The second part 51 of the outlet valve assembly 40 is further provided with a stepped cylindrical section 57 of reduced diameter which, as mentioned hereinabove, cooperates with the stepped portion 27 in the boss 22 to form the space for the sealing ring 29. As shown particularly in FIG. 2, the second part 51 is additionally provided with a further stepped portion 58 forming shoulders 58' and 59 intermediate the reduced cylindrical section 57 and the main cylindrical section 53. The shoulder 58' in conjunction with the stepped portion 27 thereby forms again a space for a sealing ring 29 while the shoulder 59 forms an abutment for the support member generally designated by reference numeral 60 which is of essentially L-shaped configuration as viewed in side view (FIG. 3). The longer leg portion 61 of the support member 60 is provided with a circular opening 62 complementary to and fitting over the circular stepped portion 58 while the smaller leg portion 63 is provided with a threaded bore 64 for engagement with the threaded section 73 of the adjusting member generally designated by reference numeral 70 whose unthreaded portion 71 is adapted to extend into the unthreaded bore 55 provided in the main circular valve housing section 53 of the second part 51. The unthreaded portion 71 (FIG. 4) of the adjusting member 70 is additionally provided with a circular groove 72 to receive a sealing ring.

Figure 5:
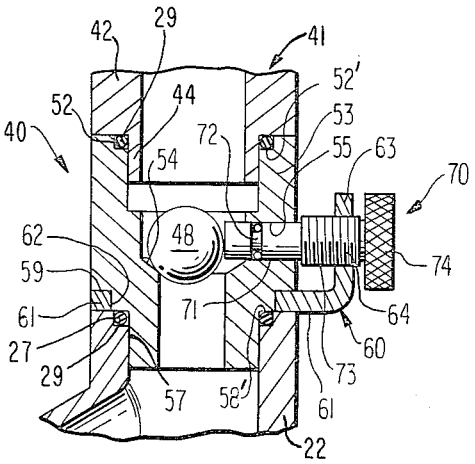
FIG. 5 is a cross-sectional view, illustrating the parts of the suck-back device of FIG. 1 in their position providing maximum suck-back effect.

To assemble the suck-back device of the present invention, it is only necessary to slip the support member 60 with its opening 62 over the reduced cylindrical section 57 and over the stepped portion 58 which is only slightly smaller in diametric dimension than the opening 62, until it abuts at the shoulder 59. The shoulder 59 is thereby spaced from the shoulder 58' by a distance corresponding to the thickness of the longer leg portion 61 so that the underside of the latter forms a flat surface with the shoulder 58' when the parts are fully assembled, at which time the threaded bore 64 is coaxial with the unthreaded bore 55, whereby the support member 60 can be rotated on the stepped portion 58 to assure such coaxial alignment in the circumferential direction. The adjusting member 70 is then inserted with its unthreaded portion 71 extending into the bore 55 until the threaded section 73 starts to engage with the threaded bore 64. The adjusting member which for convenience is provided with a knurled knob 74, can then be screwed more or less into the path of the valve 48 to provide the desired suck-back effect. In the position illustrated in FIG. 1, the adjusting member 70 is completely out of engagement with the valve ball 48, thereby providing zero suck-back effect. FIG. 5, on the other hand, illustrates the position of substantially maximum suck-back effect.

It can be seen from the foregoing that the suck-back arrangement of the present invention effectively eliminates the contact of the product to be dispensed by the filling unit with any threaded part or section of the suck-back mechanism. Additionally, the suck-back arrangement of the present invention is simple in construction and easy to clean since the various parts thereof can be readily disassembled and reassembled if necessary. Moreover, the construction is such that the parts are automatically properly aligned, i.e. the threaded bore 64 in the support member 60 will be automatically coaxial with the unthreaded bore 55 in the main cylindrical section 53 when the parts are in their fully assembled position, the rotatability of the support member 60 permitting fine adjustment in the circumferential direction to assure such coaxial positioning.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A filling unit for filling containers with a predetermined amount of a product, comprising pump means including cylinder means, piston means slidable within said cylinder means and defining a variable pump space whose volume depends on the position of the piston means during its suction and discharge stroke, inlet valve means adapted to be connected with a supply of the product to be dispensed, outlet valve means adapted to be connected at its discharge side with a discharge nozzle, means providing a communication between said inlet and outlet valve means and said pump space, said inlet valve means including a movable member operable to close off the inlet side from said communication during the discharge stroke of said pump means, said outlet valve means including a movable valve member separate from the movable member of said inlet valve means and operable to close off the discharge side from said communication during the suction stroke of said piston means, and further means providing a suck-back effect between the discharge side of said outlet valve means and said communication by preventing complete closure of the valve member of said outlet valve means during the suction stroke of the piston means, said further means including a threaded adjusting member operable to engage said valve member in such a way that complete closure is prevented, characterized in that the further means forms a sanitary suck-back device and includes a support member on said outlet valve means provided with a threaded bore disposed external of and spaced from said outlet valve means whose axis extends generally transversely to the opening and closing movements of the valve member of said outlet valve means, said threaded member having a threaded portion and an unthreaded portion, said threaded portion being in threaded engagement only with said threaded bore in the support member while said unthreaded portion extends into an unthreaded bore provided in the outlet valve means to facilitate cleaning of the various parts thereof.

2. A filling unit according to claim 1, characterized in that the threaded adjusting member adjustably projects into the path of the valve member as the latter seeks to engage its valve seat.

3. A filling unit with a valve housing in the outlet valve means according to claim 2, characterized in that the valve member is a valve ball operable to engage with its valve seat in said outlet valve means, and in that the unthreaded bore in said outlet valve means extends through the outlet valve housing approximately in the radial direction of said valve ball.

4. A filling unit according to claim 3, characterized in that said unthreaded portion of the adjusting member is provided with an annular groove receiving a sealing ring within an area thereof normally located in the unthreaded bore of the outlet valve means, when the suck-back means is in its operable position.

5. A filling unit according to claim 4, characterized in that said support member is removably mounted on and non-threadably connected with said outlet valve means.

6. A filling unit according to claim 1, characterized in that said support member is removably mounted on and non-threadably connected with said outlet valve means.

7. A filling unit according to claim 1 or 6, characterized in that the filling unit is a sanitary filling unit, whose component parts are non-threadably connected with each other.

8. A filling unit according to claim 7, characterized in that said communication includes an inclined passageway in the cylinder means.

9. A filling unit according to claim 1, characterized in that said communication includes an inclined passageway in the cylinder means.

10. A filling unit according to claim 1, 2, 3, 4, 5, 6 or 9 in which said outlet valve means has a valve seat with a predetermined axial direction, characterized in that said threaded adjusting member is disposed at a substantial angle to said axial direction.

11. A filling unit according to claim 10, characterized in that said angle is at least approximately 90°.

12. A filling unit according to claim 1, 2, 3, 4, 5, 6 or 9, characterized in that said inlet and outlet valve means are disposed at least approximately coaxially, and in that said threaded adjusting member extends at least approximately transversely to said coaxial direction.

13. A filling unit according to claim 1, characterized in that said outlet valve means includes a valve housing and provides a valve seat for said movable valve member, and on that said support member includes a portion provided with a threaded bore for threaded engagement with said threaded adjusting member, said support member portion extending alongside of and spaced from said valve housing and in the assembled condition thereof being so positioned that its threaded bore is substantially coaxial with said unthreaded bore.

14. A filling unit for filling containers with a predetermined amount of a product, comprising pump means including cylinder means, piston means slidable within said cylinder means and defining a variable pump space whose volume depends on the position of the piston means during its suction and discharge stroke, inlet valve means adapted to be connected with a supply of the product to be dispensed, outlet valve means adapted to be connected at its discharge side with a discharge nozzle, means providing a communication between said inlet and outlet valve means and said pump space, said outlet valve means including a movable valve member operable to close off the discharge side from said communication during the suction stroke of said piston means, and further means providing a suck-back effect between the discharge side of said outlet valve means and said communication by preventing complete closure of the valve member of said outlet valve means during the suction stroke of the piston means, said further means including a threaded adjusting member operable to engage said valve member in such a way that the complete closure is prevented, characterized in that the further means forms a sanitary suck-back device, whose threaded member is in threaded engagement only with a support member external of said outlet valve means and extends with an unthreaded portion thereof into an unthreaded bore of the outlet valve means to facilitate cleaning of the various parts thereof, the threaded adjusting member adjustably projecting into the path of the valve member as the latter seeks to engage its valve seat, the valve member being a valve ball operable to engage with its valve seat in said outlet valve means, the unthreaded bore in said outlet valve means extending through the outlet valve housing approximately in the radial direction of said valve ball, said unthreaded portion of the adjusting member being provided with an annular groove receiving a sealing ring within an area thereof normally located in the unthreaded bore of the outlet valve means, when the suck-back means is in its operable position, said support member being removably mounted on and non-threadably connected with said outlet valve means, the outlet valve means including a stepped portion forming a shoulder, and the support member which is approximately L-shaped in side view and of a width greater than the width dimensions of the shoulder, including a first longer leg provided with an opening substantially complementary to the configuration of said shoulder and a second shorter leg portion provided with a threaded bore to threadably receive the threaded portion of the adjusting member, the location of the threaded bore being such that it is substantially coaxial with the unthreaded bore in the outlet valve means when said first leg portion engages said shoulder.

15. A filling unit according to claim 14, characterized in that said shoulder is circular and said opening is of slightly larger diametric dimension than said shoulder while the thickness of said first leg portion essentially corresponds to the height of the shoulder in the axial direction of the outlet valve means.

16. A filling unit according to claim 15, characterized in that the filling unit is a sanitary filling unit, whose component parts are non-threadably connected with each other.

17. A filling unit according to claim 16, characterized in that said communication includes an inclined passageway in the cylinder means.

18. A filling unit for filling containers with a predetermined amount of a product, comprising pump means including cylinder means, piston means slidable within said cylinder means and defining a variable pump space whose volume depends on the position of the piston means during its suction and discharge stroke, inlet valve means adapted to be connected with a supply of the product to be dispensed, outlet valve means adapted to be connected at its discharge side with a discharge nozzle, means providing a communication between said inlet and outlet valve means and said pump space, said outlet valve means including a movable valve member operable to close off the discharge side from said communication during the suction stroke of said piston means, and further means providing a suck-back effect between the discharge side of said outlet valve means and said communication by preventing a complete closure of the valve member of said outlet valve means during the suction stroke of the piston means, said further means including a threaded adjusting member operable to engage said valve member in such a way that complete closure is prevented, characterized in that the further means forms a sanitary suck-back device, whose threaded member is in threaded engagement only with a support member external of said outlet valve means and extends with an unthreaded portion thereof into an unthreaded bore of the outlet valve means to facilitate cleaning of the various parts thereof, said support member being removably mounted on and nonthreadably connected with said outlet valve means, the outlet valve means including a stepped portion forming a shoulder, and the support member which is approximately L-shaped in side view and of a width greater than the width dimension of the shoulder, including a first longer leg portion provided with an opening substantially complementary to the configuration of said shoulder and a second shorter leg portion provided with a threaded bore to threadably receive the threaded portion of the adjusting member, the location of the threaded bore being such that it is substantially coaxial with the unthreaded bore in the outlet valve means when said first leg portion engages said shoulder.

19. A filling unit according to claim 18, characterized in that said shoulder is circular and said opening is of slightly larger diametric dimension than said shoulder while the thickness of said first leg portion essentially corresponds to the height of the shoulder in the axial direction of the outlet valve means.

* * * * *